United States Patent [19]

Warren

[11] 3,977,107

[45] Aug. 31, 1976

[54] ILLUMINATED DISPLAY BOX FOR NAVIGATIONAL AIDES

[76] Inventor: Carl D. Warren, Rte. 1, Box 99A, Land O'Lakes, Fla. 33539

[22] Filed: Feb. 21, 1975

[21] Appl. No.: 551,832

Related U.S. Application Data

[63] Continuation of Ser. No. 408,597, Oct. 23, 1973, abandoned.

[52] U.S. Cl. ..... 40/86 R; 40/132 R

[51] Int. Cl.[2] ..... G09F 11/24

[58] Field of Search ..... 40/86–95, 40/132 R, 132 H, 31; 353/95; 354/339, 214; 352/221 X

[56] References Cited

UNITED STATES PATENTS

| | | | |
|---|---|---|---|
| 2,075,753 | 3/1937 | Weiss | 352/221 X |
| 2,764,826 | 10/1956 | Fulton et al. | 40/86 R |
| 3,675,352 | 7/1972 | Barrow | 40/86 R |
| 3,771,245 | 11/1973 | Mabrey et al. | 40/132 R X |

*Primary Examiner*—Louis G. Mancene
*Assistant Examiner*—John H. Wolff
*Attorney, Agent, or Firm*—John W. Adams

[57] ABSTRACT

This is an illuminated display box light sealed except for an illuminated display window and a translucent display strip mounted on a pair of rollers and particularly constructed to display sequentially arranged navigational aid information to the pilot of a boat at night without producing glare in other areas of the wheelhouse thus preventing impairment of the pilot's vision at night while still providing ready access to said navigational information displayed on the portion of the strip located in the display window.

1 Claim, 4 Drawing Figures

ILLUMINATED DISPLAY BOX FOR NAVIGATIONAL AIDES

This application is a continuation of my previously filed application, Ser. No. 408,597, filed Oct. 23, 1973 now abandoned and entitled: ILLUMINATED DISPLAY BOX FOR NAVIGATIONAL AIDES.

Pilots of ships, particularly river boats, frequently have difficulty reading the navigating charts at night. One of the problems is locating the desired chart and thereafter reading the same without providing excessive light which impairs the night vision of the pilot outside of the wheelhouse.

It is an object of the present invention to provide an illuminated information-containing strip of translucent sheet material compiled for a particular route so that the navigation aides appear sequentially on the strip in the progressive order of travel and wherein the strip is housed within a sealed box and may be moved progressively across an illuminated display window without illuminating other areas of the pilothouse.

More specifically it is an object to provide a light confining display box having a window in the top panel and a pair of reversible spaced-apart rolls on which the ends of an elongated translucent information-containing strip are mounted for adjustable positioning in the display window which is illuminated from below the strip and provided with sealing means for preventing light from escaping along the edges of the strip through the display window.

These and other objects and advantages of this invention will more fully appear from the following description made in connection with the accompanying drawing in which like reference characters refer to similar parts throughout the several views, and, in which.

Figure 1:
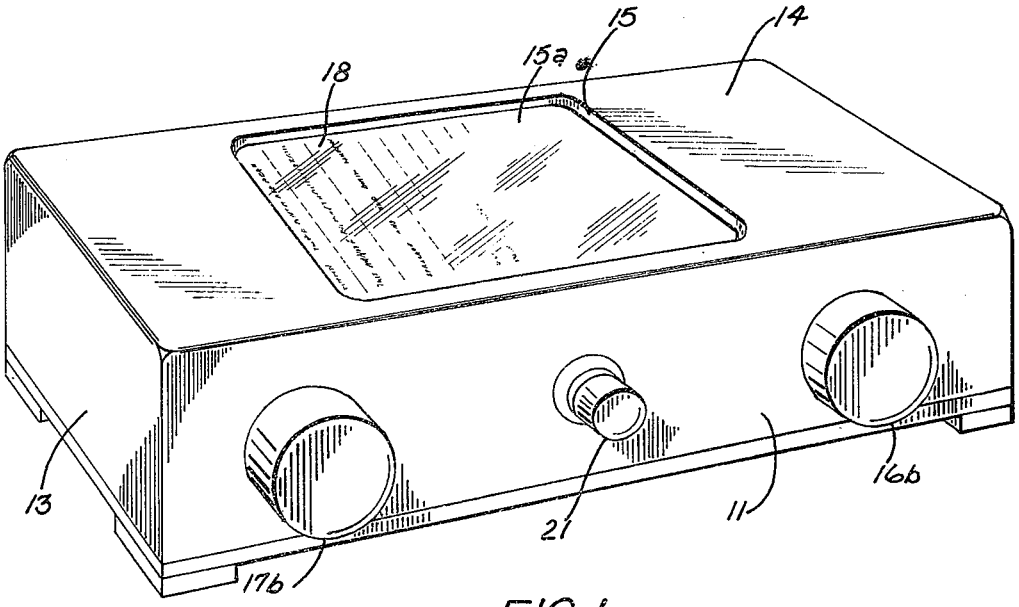
FIG. 1 is a perspective view of my illuminated display box.
Figure 2:
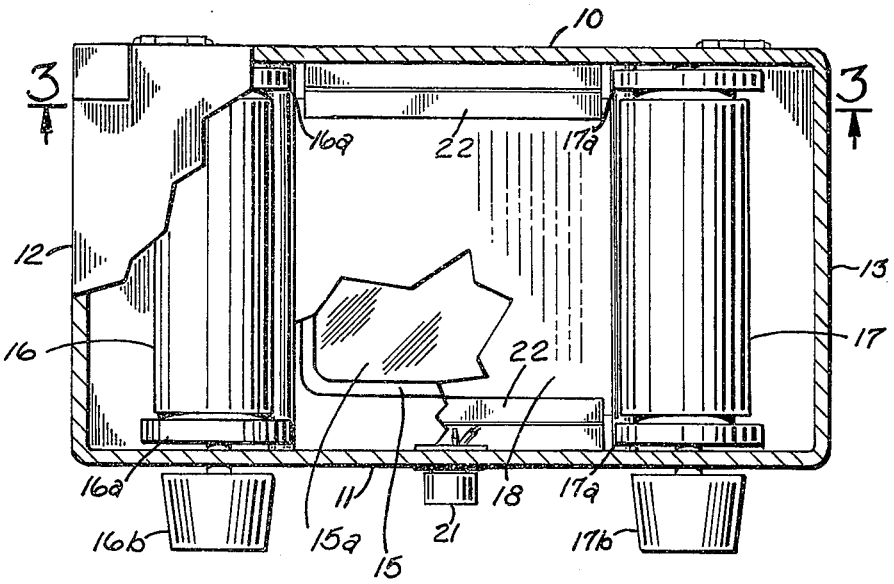
FIG. 2 is a bottom plan view thereof with a portion broken away.
Figure 3:
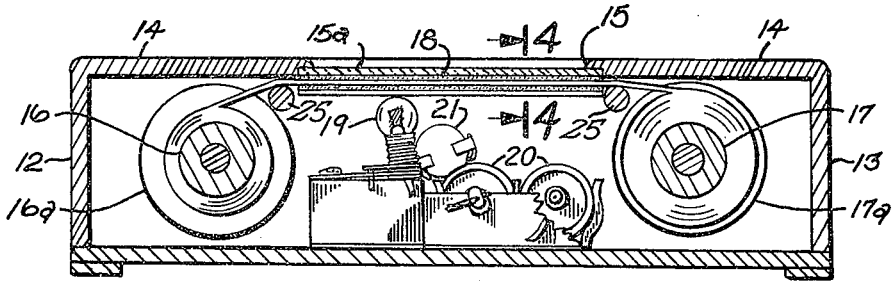
FIG. 3 is a longitudinal sectional view taken substantially along the line 3—3 of FIG. 2; and, FIG. 4 is a fragmentary transverse sectional view taken substantially along the line 4—4 of FIG. 2.
Figure 4:
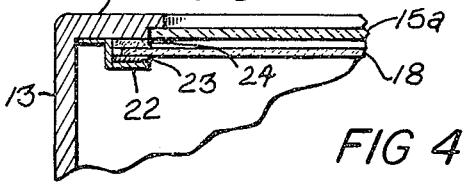

As illustrated in the accompanying drawing, I provide a box B having a bottom 9, sides 10 and 11, ends 12 and 13 and a top panel 14 having a window 15 therein. A pair of rolls 16 and 17 having flanges **16*a* and 17*a* are rotatably mounted between the sides 10 and 11 in relatively closely spaced relation to the ends 12 and 13. Rotating knobs 16*b* and 17*b* are respectively provided for rotating said rolls 16**.

An elongated strip of translucent sheet material 18 such as paper having the desired navigation information information printed in the desired sequence thereon has its respective ends attached to the rolls 16 and 17 by any suitable means to permit the strip to be rolled up on said rolls and thus permitting the desired area thereof to be displayed below the window 15 of the box. In the form shown the window opening has a glass panel **15*a* mounted therein. A self-containing light source having a bulb 19, batteries 20 and a switch 21 is provided below the window and strip 18** to illuminate said strip and facilitate reading the same in the dark.

The edges of the strip are confined between a pair of light sealing rail members 22. The upper surfaces thereof underlying the strip 18 being provided with a suitable light seal such as the strip of felt 23 secured thereto as by being glued. A second light seal may be provided below the marginal edges of the top 14 such as the strip of felt 24 disposed in opposed relation to the light seal 23 and combines therewith to form a light sealing guide path for the edges of the translucent information-containing strip 18. The two sealing elements 23 and 24 are designed to positively prevent light from escaping the box and, of course, the ends and sides of the box are opaque so that the light from the bulb 19 is completely confined within the box except for illuminating the translucent strip 18. A pair of guide bars or rollers 25 align the strip with the guide path formed by the rails 22.

The information contained on the strip 18 is sequentially arranged in the desired progressive order for a predetermined route so that the various beacon lights and signals with their specific identifying codes are provided in the order in which they will appear to the boat pilot traveling that route.

It will be seen that I have provided an illuminated display box specifically for use designed by a boat pilot at night to facilitate access to navigation information.

It will, of course, be understood that various changes may be made in the form, details, arrangement and proportion of the parts without departing from the scope of this invention as set forth in the appended claim.

What is claimed is:

1. An illuminated display box for displaying sequentially prepared navigational information for boat pilots, comprising a box having a bottom, sides, ends and a top panel all sealingly attached together so as to form an opaque enclosure;

a rectangular display window in said top panel;

a pair of reversible spaced-apart rolls rotatably mounted in said box between the sides thereof in close association to said ends;

means for rotating said rolls;

an elongated sequentially arranged information-containing strip of translucent sheet material attached at its respective ends to said rolls and extending therebetween in underlying relation to said display window;

a pair of rail elements mounted in slightly spaced relation below said top to form a pair of channels respectively extending the full length of said window on opposite sides of said window, a pair of felt strips mounted on each side of said window with each of said channels in opposed face to face relation to form a strip engaging and light sealing track which sealingly engages the opposed marginal edges of the portion of the strip disposed below said window;

means subjacent the portion of the strip aligned with the window for supplying light within said box below said display window to permit information contained on said strip to be easily read in the dark without permitting light to escape from the box except through said strip portion and window.

* * * * *